US005867838A

United States Patent [19]

Corry

[11] Patent Number: 5,867,838

[45] Date of Patent: Feb. 9, 1999

[54] SOCK FOR USE WITH OPEN TOE SANDAL TYPE FOOTWEAR

[76] Inventor: Charles Corry, 2336 N. Commonwealth, #104, Chicago, Ill. 60614

[21] Appl. No.: 74,067

[22] Filed: May 6, 1998

[51] Int. Cl.[6] ..... A43B 17/00

[52] U.S. Cl. ..... 2/239; 2/409; 66/178 R

[58] Field of Search ..... 2/239, 409; 66/178 R, 66/184, 185; 36/109, 109 R, 11.5; D2/980

[56] References Cited

U.S. PATENT DOCUMENTS

| | | | |
|---|---|---|---|
| 1,798,201 | 3/1931 | Hedges | 2/239 |
| 1,877,393 | 9/1932 | Friedman et al. . | |
| 1,936,064 | 11/1933 | Mills . | |
| 2,332,252 | 10/1943 | Payne | 2/239 X |
| 2,334,206 | 11/1943 | Knohl | 2/178 R |
| 2,424,056 | 7/1947 | Ruth | 2/239 |
| 2,629,996 | 3/1953 | Hamilton | 2/178 R |
| 2,904,980 | 9/1959 | Stinson . | |
| 3,102,271 | 9/1963 | Wilkerson . | |
| 3,143,870 | 8/1964 | Smith . | |
| 3,887,946 | 6/1975 | Laskin et al. . | |
| 5,054,129 | 10/1991 | Baehr | 2/409 |
| 5,404,657 | 4/1995 | Honeycutt . | |

FOREIGN PATENT DOCUMENTS

| | | | |
|---|---|---|---|
| 451979 | 10/1948 | Canada | 2/239 |
| 696439 | 12/1930 | France | 2/239 |
| 256032 | 12/1927 | Italy | 2/239 |

OTHER PUBLICATIONS

Acorn® SandalSox mailer (1 p.) (available to applicant approximately Dec., 1997).

"Acorn brings out sock for sport sandal wearers," by Footwear News, vol. 48, No. 49, Dated Dec. 7, 1992 (1 p.).

"Swathing Sandaled Feet" by Sporting Goods Business, Dated Oct., 1992 (1 p.).

"Special Socks For Sandals, Skiing; Shake Those Booties," by Ski Tech, Dated Nov./Dec. 1992 (1 p.).

*Primary Examiner*—Gloria M. Hale

*Attorney, Agent, or Firm*—Leydig, Voit & Mayer, Ltd.

[57] ABSTRACT

A sock for use with sandals having an open toe area is provided. The sock includes a sole portion adapted such that when worn the sole portion covers substantially the entire lower surface of the foot extending rearward from the toes. The sock is secured to a user's foot and the sole portion properly tensioned into tight engagement with the user's foot by forward and intermediate support bands which are attached at either end to opposing sides of the sole portion and are adapted to extend over the top of a user's foot when worn. The sock is further secured by a heel band which extends upwardly from the rear end of the sole portion to a ankle support portion which has a cylindrical configuration designed to encircle a user's ankle when the sock is worn. The forward, intermediate and heel support bands and the ankle support defining substantially open sides, top and toe areas.

7 Claims, 3 Drawing Sheets

SOCK FOR USE WITH OPEN TOE SANDAL TYPE FOOTWEAR

FIELD OF THE INVENTION

This invention generally relates to footwear and, more particularly, to a sock which is specifically configured for use with sandal type footwear having an open toe such as sport sandals.

BACKGROUND OF THE INVENTION

Sandals are experiencing a rapid growth in popularity as a footwear choice. One particular type of sandals which have become extremely popular are what are commonly referred to as "sport" sandals. Sport sandals are configured to be more suitable for use in athletic type activities and generally comprise a rugged sole which can be secured in a relatively tight manner, as compared to other types of sandals, to the foot by a plurality of straps which leave the toe area open.

A number of different problems and/or issues arise with the use of sandals, and specifically sport sandals, which could be alleviated by wearing socks on at least an occasional basis when wearing the sandals. For example, when wearing sandals, particularly during more rigorous activities, sweat and other moisture is absorbed into the sole of the sandal which with extensive use eventually results in an unpleasant odor. This can be avoided, or at least delayed, by utilizing a sock which is capable of absorbing a great deal of this moisture. Additionally, breaking in a new pair of sandals, or even prolonged use sandals, often can lead to discomfort, foot irritation and even blistering which could be avoided by wearing a sock that would cushion the foot. Wearing socks with sandals can also help prevent against the penetration of dirt and grit and allow the sandals to be used during colder weather.

The use of conventional socks with sandals, however, poses a number of problems from both a practical and an aesthetic standpoint. Conventional socks can often be too warm, substantially eliminating the airy feel which is one of the most popular attributes of sandals. Moreover, since a much larger portion of the sock is visible as a result of the openness of the sandal, particularly those having an open toe area, conventional socks can tend to overwhelm the appearance of the sandals. Thus, conventional socks detract from the aesthetic appearance of the sandal and produce a look which many consumers perceive as unattractive. While some partial sock products are known, they are generally not suitable for prolonged use because they tend to slip and bunch resulting in discomfort. In addition, the toe area is covered detracting from the overall open appearance and feel of the sandals.

OBJECTS AND SUMMARY OF THE INVENTION

Accordingly, in view of the foregoing it is a general object of the invention to provide a sock for use with sandal type footwear which does not substantially detract from the open appearance and feel of the sandal.

A more specific object of the present invention is to provide a sock of the foregoing type which is substantially undetectable when worn with open toe sandal type footwear thereby providing an aesthetically pleasing appearance.

Another object of the present invention is to provide a sock of the foregoing type which helps alleviate foot odor problems associated with the use of athletic sandals.

A further object of the present invention is to provide a sock as described above which does not slide or bunch even during rigorous use.

These and other features and advantages of the invention will be more readily apparent upon reading the following description of a preferred exemplary embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Referring now more particularly to FIGS. 1–4, there is shown an illustrative embodiment of a sock 10 constructed in accordance with the teachings of the present invention. The illustrated sock is specifically configured to be used with sandal type footwear having an open toe area, such as sport sandals. In particular, the sock 10 of the present invention provides the advantages of a conventional sock such as added comfort and odor protection, but is only minimally visible when worn with a sandal so as to not detract from the appearance and open feeling of the sandal. In one preferred embodiment, the sock 10 may be cut from a seamless tube of cotton ribbed terry cloth knit fabric which includes a certain amount of LYCRA in order to enable the fabric to stretch. It will be appreciated however that any fabric of suitable strength and durability may be used. Moreover, while the invention will be described in connection with a certain exemplary configuration which has particular use with sport sandals, it will be readily appreciated from the following description that the design may be varied to make the sock complementary to different types of sandals.

Figure 4:
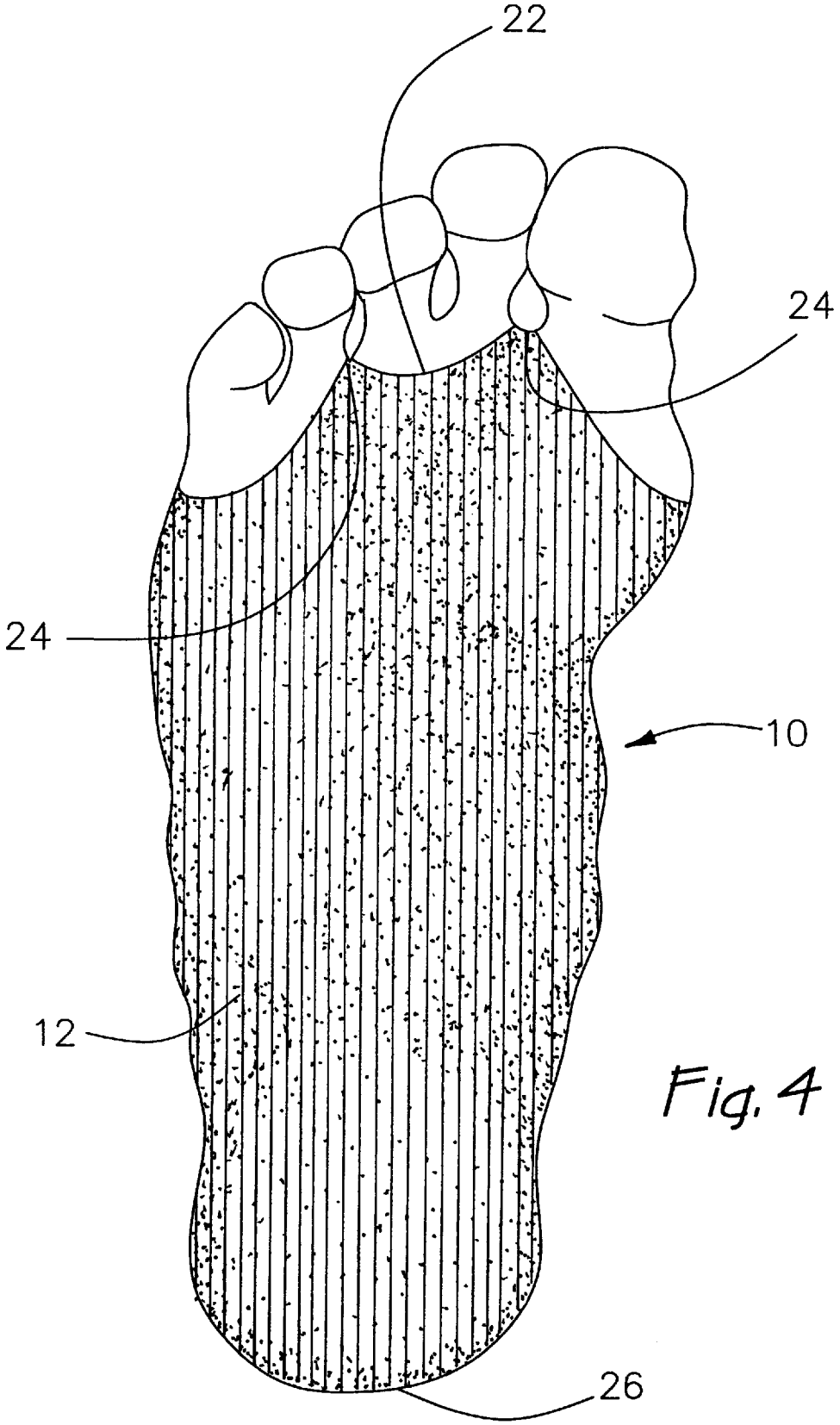
FIG. 4 is a bottom view of the illustrative sock of FIG. 1.

In order to help alleviate foot odor problems and provide maximum cushioning, the sock includes a sole portion 12 which is configured to cover substantially the entire lower surface of a foot. As shown in FIG. 4, the sole portion 12 comprises a solid piece of fabric which is sized so as to span the entire width of a user's foot and extend from his or her heel to the balls of the foot just short of the toes. As will be appreciated, the sock 10 can be made in various sizes to ensure that the bottom of a user's foot is substantially covered. In this way the bottom of the foot, which is generally not visible when wearing sandals, is provided with maximum cushioning to help prevent discomfort and blistering even when breaking in a new pair of sandals. Additionally, the fabric of the sole portion 12 helps pull moisture away from the foot and the sole of the sandal thereby helping to control odor. The moisture absorbing properties of the sock 10 can be even further enhanced through the use of modern moisture absorbing fabrics.

Figure 1:
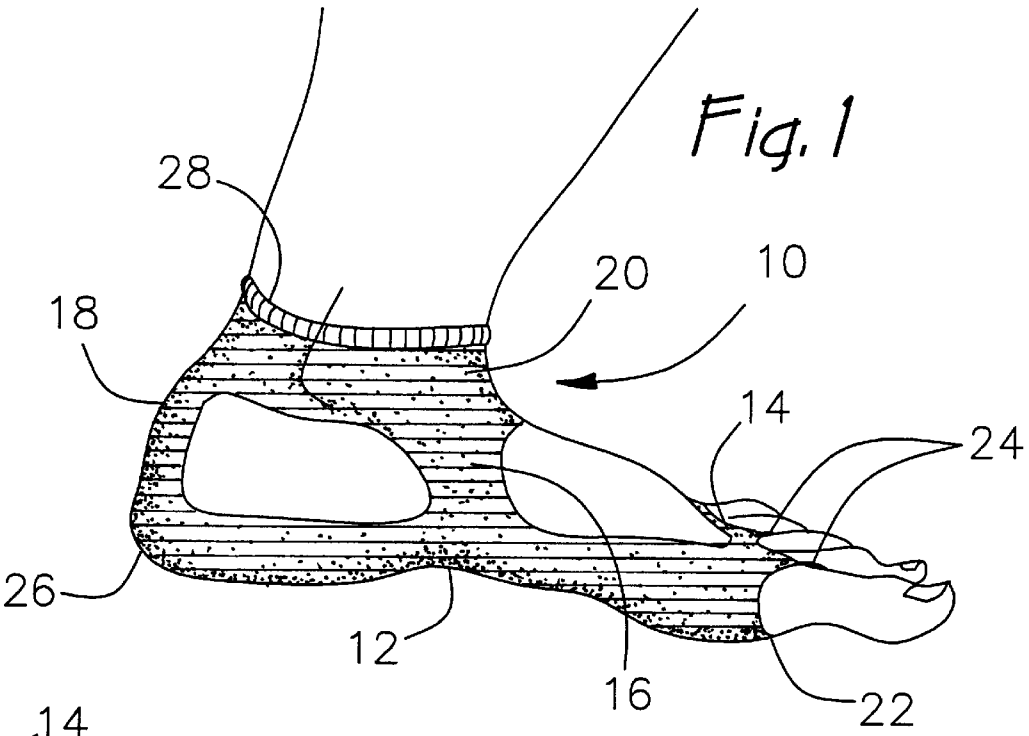
FIG. 1 is a side perspective view of the inner side of an illustrative sock intended for use with open toe sandal type footwear constructed in accordance with the present invention.
Figure 2:
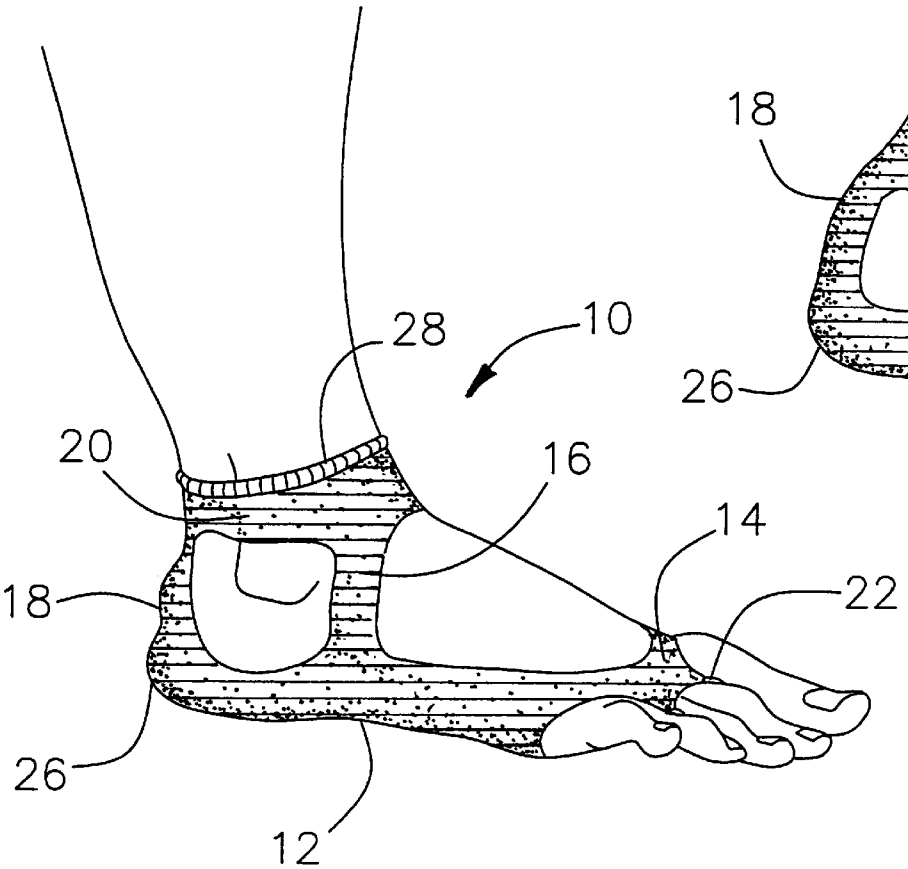
FIG. 2 is a side perspective view of the outer side of the illustrative sock of FIG. 1.
Figure 3:
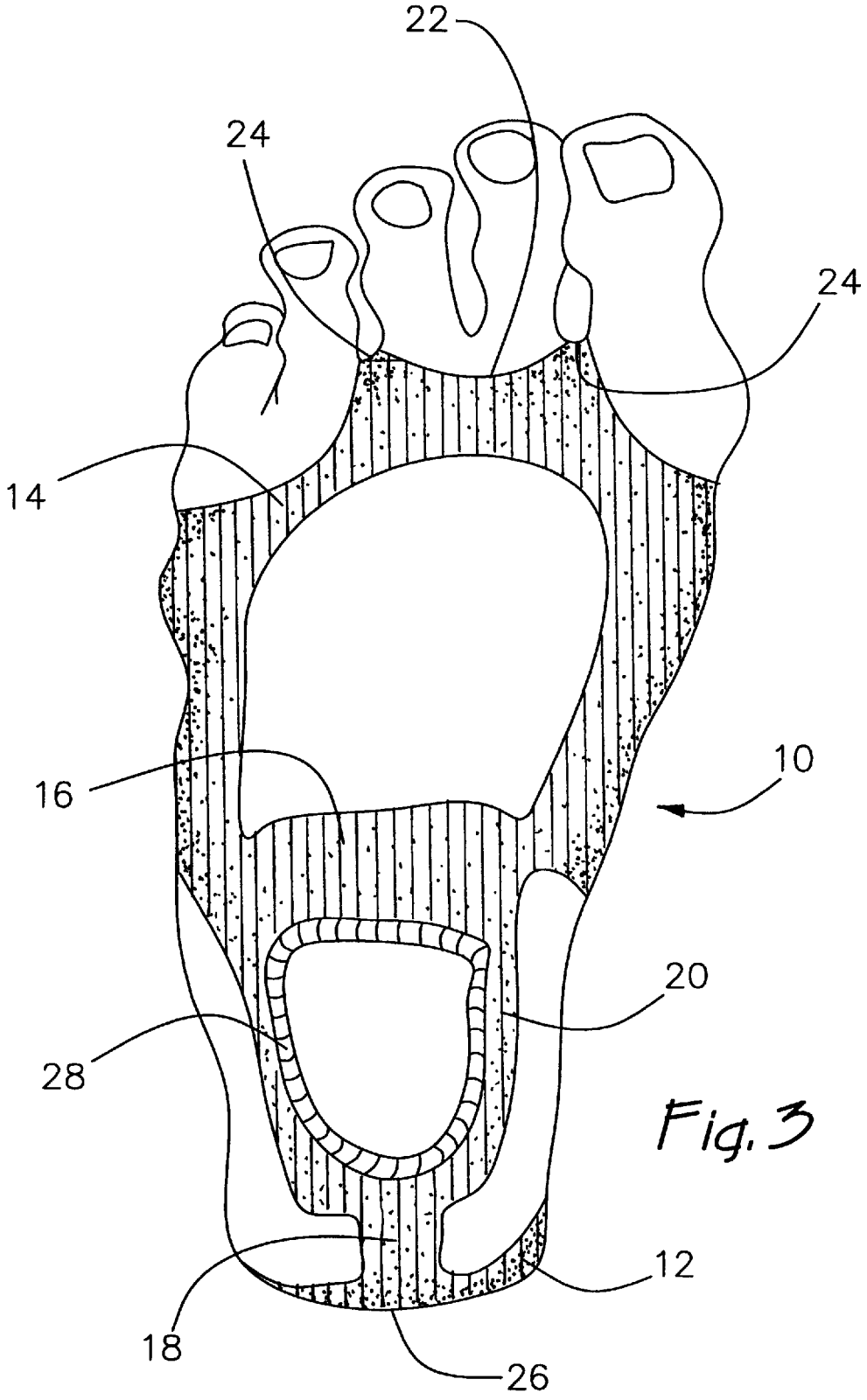
FIG. 3 is a top plan view of the illustrative sock of FIG. 1.

For securely retaining the sole portion 12 of the sock 10 to a user's foot so as to prevent sliding and bunching, the sock 10 includes a three-point support structure. As shown in FIGS. 1–3, this three-point support structure includes, in this instance, a forward support band 14, an intermediate support 16 and a heel support band 18 which is affixed to an ankle support portion 20. The forward support band 14 extends in an arcuate configuration between the opposing sides of the sole portion 12 adjacent the front end 22 of the sock 10 and is adapted to tension and thereby hold the forward section of the sole portion in tight engagement with the bottom of a user's foot. In the illustrated embodiment, the forward support band 14 is positioned so that it extends across a user's foot just rearward of the toes. The particular location and width of the forward support band 14 preferably is such that it substantially underlies the forward strap of most sport sandals. Since the forward support band 14 is intended to underlie one of the straps of the sandal, it can also serve as a pad which helps prevent chafing or other discomfort caused by the engagement of the strap with the user's foot. Those skilled in the art will appreciate that the location of the forward band 14 may be varied to complement the location of the forward strap on the sandals with which the sock is intended to be worn.

For preventing the sole portion 12 from curling or sliding rearward under the foot towards the heel during use, the forward support band 14 can also connected to the sole portion 12 by, in this case, a pair of toe bands 24 which further tension the sole portion 12 of the sock 10. As best shown in FIGS. 1 and 3, the toe bands 24 are disposed and sized such that when the sock 10 is worn, the toe bands 24 pass between the user's toes and as such are substantially not visible. While the illustrated embodiment has two toe bands 24, it will be appreciated that one or more toe bands could be provided or they could be eliminated altogether.

In order to prevent the sole portion 12 of the sock 10 from curling or sliding forward out from under the heel, the heel support band 18 is provided. As shown in FIGS. 1–3, the heel band 18 extends upwardly from the rear end 26 of the sole portion 12 and ties into the ankle support 20 such that the heel band extends vertically up the back of a user's foot when the sock 10 is worn. In order to limit its visibility, the heel band 18 preferably is constructed as narrow as possible. The heel band 18 also provides padding on the back of the user's foot where the heel strap of a sandal engages the user's foot. As is known, this is an area that frequently can become irritated as a result of the rubbing of the rear heel strap of the sandal. Moreover, since the heel band 18 extends in a vertical direction, it will provide padding no matter where the heel strap rides on the user's foot (e.g., higher or lower).

The heel band 18 is secured to the upper portion of a user's foot through the ankle support portion 20 of the sock 10. The ankle support 20 comprises a generally cylindrical piece of fabric which is sized to encircle and tightly engage the ankle of a user when the sock 10 is worn. In order to ensure that the ankle support portion 20 tightly engages the ankle, an elastic band 28 can be provided at the upper end thereof. As best shown in FIGS. 1 and 2, in the illustrated embodiment, the heel band 18 is tied into the ankle support portion 20 at the rear end of the sock 10, and the tension is applied to the sole portion 12 through the heel band 18 as a result of engagement of the ankle support 20 with the user's foot. As with the heel band 18, the ankle support 20 is preferably made as narrow as possible in order to minimize visibility.

To further prevent sliding of the sock 10, and in particular the sole portion 12, the intermediate support band 16 can be provided. As shown in FIGS. 1–3, the intermediate support band 16 is secured at either end to the opposing sides of the sole portion 12 and is adapted to extend in an arcuate manner across the top of a user's foot. The intermediate band 16 ensures that the center area of the sole portion 12 is kept tensioned and in tight engagement with the user's foot. In the illustrated embodiment, the intermediate band 16 is tied into the ankle support 20 to further ensure proper tensioning of the sole portion 12 of the sock 10. As with the forward band 14, the intermediate band 16 is preferably sized and disposed so as to underlie a strap on a sandal, and as such, therefore also provides padding. It will be appreciated that the intermediate band 16 may have configurations other than that shown in order ensure that it is complementary to the sandal with which it is to be worn. For example, the intermediate band 16 may not be tied into the ankle support 20.

In order to provide the sock 10 with increased elasticity, durability and structural stability, elastic can be provided along the various edges of the sock. Specifically, in one preferred embodiment, the edges of the support bands 14, 16, 18, 20 and the sole portion 12 can be constructed with fine grade elastic fibers which is enclosed in thread binding.

As can be seen from FIGS. 1–4 the support bands 14, 16, 18, 20 define substantially open areas of the sock on either side, on the top and in the toe area. This enables the sock 10 to not substantially detract from the open feeling and look that is associated with wearing sandals. In order to maximize this openness, it is preferable that the various portions of the sock 10 be configured such that as much of the sock as possible is hidden behind the sandal with which it is to be worn. The sock 10, however, could also be adapted so that a larger portion of the sock is visible beyond the outline of the sandal. In these cases, the visible portions could be colored and/or provided with a design or insignia that would enhance the appearance of the sock and the footwear.

From the foregoing, it can be seen that the sock of the present invention provides advantages such as added comfort and odor protection while having aesthetically pleasing appearance that does not detract from the open feeling or look of sandals, particularly those having an open toe area. Additionally, the visible portions of the sock can be provided with a design which enhances the appearance of the sock and footwear. While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and the scope of the invention as defined by the following claims.

What is claimed is:

1. A sock to be worn on a foot for use with sandal type footwear having an open toe area, the sock comprising:

a sole portion having front and rear ends and opposing sides, the sole portion being adapted to substantially cover a bottom portion of a human foot from the heel of the foot to adjacent the toes of the foot, a forward support band having two ends and wherein either end is attached to a respective one of the opposing sides of the sole portion adjacent the front end thereof, the forward support band being adapted to extend over the top of the foot, and a heel support band having two ends and wherein a first end is attached to the sole portion adjacent the rear end thereof and a second end to an ankle support portion which is adapted to encircle the ankle of the foot.

2. The sock according to claim 1 further including intermediate support band having two ends and wherein either end is attached to a respective one of the opposing sides of the sole portion between the front and rear ends thereof, the forward support band being adapted to extend over the top of the foot.

3. The sock according to claim 2 wherein the forward, intermediate and heel support bands and the ankle support portion define substantially open opposing sides, top and toe areas of the sock.

4. The sock according to claim 2 wherein the sole portion, forward support band, intermediate support band, heel support band and ankle support portion have edges which are constructed of elastic.

5. The sock according to claim 2 wherein the intermediate support band is connected to the ankle support portion.

6. The sock according to claim 1 further including at least one toe having two ends and wherein one end is attached to the forward support band and wherein the opposing end is attached to the sole portion, the toe band being adapted to extend through and between the toes of the foot.

7. The sock according to claim 6 wherein a plurality of toe bands are provided.

* * * * *